United States Patent [19]

Labelle

[11] Patent Number: 4,628,982

[45] Date of Patent: Dec. 16, 1986

[54] INSULATED CLOSURE PANEL

[75] Inventor: H. M. Robert Labelle, Cornwall, Canada

[73] Assignee: Martinray Industries Ltd., Cornwall, Canada

[21] Appl. No.: 598,818

[22] Filed: Apr. 10, 1984

[30] Foreign Application Priority Data

May 2, 1983 [CA] Canada ..... 427213

[51] Int. Cl.[4] ..... E06B 9/386; E06B 9/14

[52] U.S. Cl. ..... 160/235; 160/232

[58] Field of Search ..... 160/133, 235, 232, 236

[56] References Cited

U.S. PATENT DOCUMENTS

| | | | |
|---|---|---|---|
| 546,858 | 9/1895 | Kinnear | 160/232 |
| 1,352,656 | 9/1920 | Cahill | 160/235 |
| 3,104,699 | 9/1963 | Wolf et al. | 160/232 X |
| 3,485,287 | 12/1969 | Milbourne | 160/235 |
| 3,772,129 | 11/1973 | Dover | 160/236 |
| 4,173,247 | 11/1979 | Piano | 160/236 |
| 4,436,136 | 7/1985 | Downey | 160/232 |

FOREIGN PATENT DOCUMENTS

| | | | |
|---|---|---|---|
| 2808177 | 8/1979 | Fed. Rep. of Germany | 160/235 |
| 812050 | 4/1959 | United Kingdom | 160/232 |
| 2011512A | 7/1979 | United Kingdom | 160/133 |

*Primary Examiner*—Ramon S. Britts
*Assistant Examiner*—Cherney S. Lieberman
*Attorney, Agent, or Firm*—Charles E. Brown; Charles A. Brown

[57] ABSTRACT

An insulated closure panel for a rolling closure. The panel has a metallic section with an outer wall and side walls, and a thermoplastic section with an inner wall. Both panel sections have male and female hinge sections on their sides. The thermoplastic panel section snaps into the metallic panel section to form a tubular panel with the male hinge sections cooperating to form a male hinge element on one side of the panel and with the female hinge sections cooperating to form a female hinge element on the other side of the panel. The panel can be filled with insulating material.

A rolling closure is formed from a plurality of the above panels, the male hinge element of each panel pivotally connected to the female hinge element of an adjacent panel.

7 Claims, 8 Drawing Figures

INSULATED CLOSURE PANEL

BACKGROUND OF THE INVENTION (A) Field of Invention

This invention is directed toward a panel for use in closures, and more particularly toward an insulated closure panel for use in rolling closures. The invention is also directed toward closures incorporating the closure panels.

(B) Description of the Prior Art

It is known to provide insulated panels for use in rolling closures. Each insulated panel comprises inner and outer metallic walls connected together at the sides of the panel. A male hinge element is located on one side of the panel and a female hinge element is located on the other side of the panel. One panel is pivotally connected to the next by slidably connecting the male hinge element of one panel in the female hinge element of the adjacent panel. Each panel is filled with an insulating material.

These known insulated panels have disadvantages however. The metal-to-metal contact between the outer and inner walls at the sides causes heat loss by conduction from the inner wall to the outer wall. Also, the use of metallic inner and outer walls makes the panels quite heavy and expensive. Further, the hinge elements on each panel are formed by bending the walls of the panels which bending step adds to manufacturing costs making the panels expensive. In addition, inadequate sealing between adjacent panels results in higher heat loss through the closure incorporating the panels.

It is known to provide an improved insulated closure panel which comprises an outer metallic panel section and an inner thermoplastic panel section. The inner panel section is tubular and is adhesively mounted to the back surface of the metallic panel section. The inner panel section is filled with insulation. The inner thermoplastic panel section lightens the closure panel and prevents heat loss by conductance between the inner and outer surfaces of the panel. However, the inner panel section does not extend completely across the outer panel section thereby reducing the panel's insulating properties. In addition, the adhesive connection between the inner and outer panel sections requires an additional manufacturing step and additional materials. The adhesive connection could also fail if the adhesive is not properly applied. This improved closure panel also has poor sealing between adjacent panels resulting in higher heat loss through the closure incorporating the panels.

SUMMARY OF THE INVENTION

It is the purpose of the present invention to provide an improved insulated closure panel which avoids, or at least minimizes, the disadvantages of the known panels. In accordance with the present invention there is provided a closure panel having an outer, metallic, panel section and an inner, thermoplastic, panel section. The inner panel section is resiliently connected to the outer panel section at the side walls of the panel forming a tubular structure which is then filled with an insulating material extending from one side of the panel to the other. The construction, in employing a separate thermoplastic panel section, reduces the weight of the panel and also prevents heat loss by conduction from the inner surface to the outer surface of the panel, since the plastic sections form the inner surface of the closure when the panels are hingedly connected together. In resiliently connecting the inner panel section to the outer panel section at the sides of the panel, no separate manufacturing step or material is required to join the panel sections together. One merely snaps the inner panel section in place within the outer panel section. Also, since the inner panel section extends from one side of the outer panel section to the other, the insulation material can also extend completely across the panel thereby improving its insulating properties.

The improved panel has the panel sections formed by extruding which further reduces the manufacturing costs. In addition, the panels are constructed to provide improved sealing between adjacent panels when they are hingedly connected together in a closure thereby reducing or eliminating drafts through the closure and reducing heat loss.

The invention is particularly directed toward a panel for a closure comprising a metallic outer wall and a thermoplastic inner wall. The panel has a first side wall with a metallic and thermoplastic male hinge element thereon and a second side wall with a metallic and thermoplastic female hinge element thereon.

The invention is also directed toward a panel for a closure having a metallic panel section with an outer wall and first and second side walls, and a thermoplastic panel section with an inner wall and extending between the side walls.

BRIEF DESCRIPTION OF THE DRAWINGS

The invention will now be described in detail having reference to the accompanying drawings in which.

DESCRIPTION OF THE PREFERRED EMBODIMENTS

Figure 1:
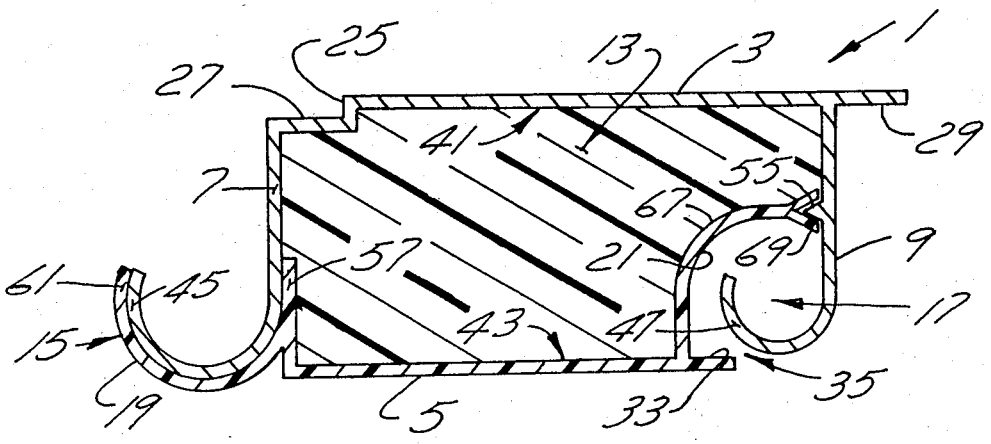
FIG. 1 is a cross-section view of the panel of the present invention.

The insulated panel 1, as shown in FIG. 1, has a metallic outer wall 3, a parallel thermoplastic inner wall 5, and side walls 7, 9. The side walls 7, 9 are preferably metallic and integral with the outer wall 3. The outer and inner walls 3, 5 and the side walls 7, 9, define a tubular member with a generally rectangular cross-sectional shape. The tubular member is filled with an insulating material 13 such as an expandable foam.

Figure 2:
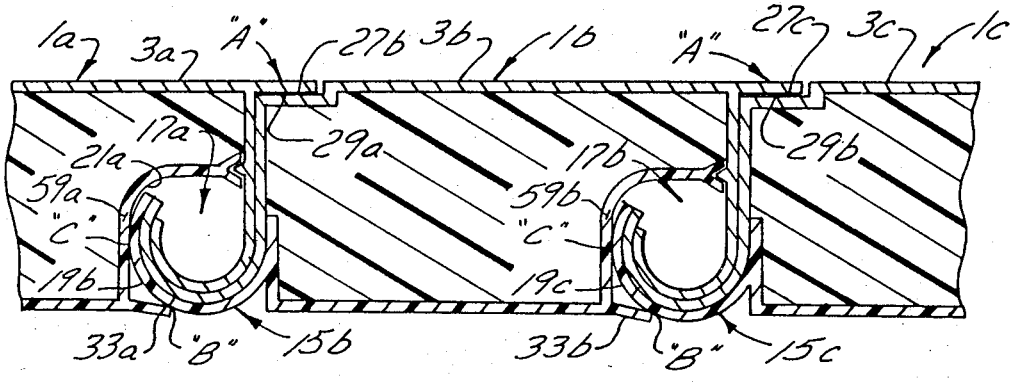
FIG. 2 is a detail view of a closure using the panels of the present invention.

A male hinge element 15 is provided on the outside of the first side wall 7, adjacent the inner wall 5. A female hinge element 17 is provided on the inside of the second side wall 9, adjacent the inner wall 5. The male and female hinge elements 15, 17 are sized to have the male hinge element 15 snugly, rotatably fit within the female hinge element 17. The outer surface 19 of the male hinge element 15 is preferably thermoplastic as is the outer surface 21 of the female hinge member 17. When the male hinge element 15 of one panel is rotatably mounted within the female hinge element 17 of an adjacent panel, as shown in FIG. 2, the thermoplastic outer surfaces 19, 21 of the hinge elements 15, 17 respectively, contact to provide a good seal between adjacent panels as will be shown.

The panel 1 has additional means for providing a better seal between adjacent panels in a closure. One of the additional sealing means comprises a shallow step 25 formed in the outer wall 3 near one side wall 7 so that a short section 27 of the outer wall 3 adjacent side wall 7 is slightly recessed. An extension 29 of the outer wall 3 projects past the other side wall 9. When two panels 1 are hingedly connected together, the extension 29 of one panel overlies the other panel, as shown in FIG. 2, fitting snugly on the recessed section 27 so that the extension 29 of the one panel is aligned with the outer wall 3 of the other panel.

Another of the additional sealing means can comprise an extension flap 33 of the inner wall 5 extending toward the other side wall 9. The flap 33 extends into the opening 35 to female hinge element 17, as shown in FIG. 1, and rests on the outer thermoplastic surface 19 of a male hinge element 15, as shown in FIG. 2, that is rotatably mounted within the female hinge element 17 to provide an additional seal.

Figure 3:
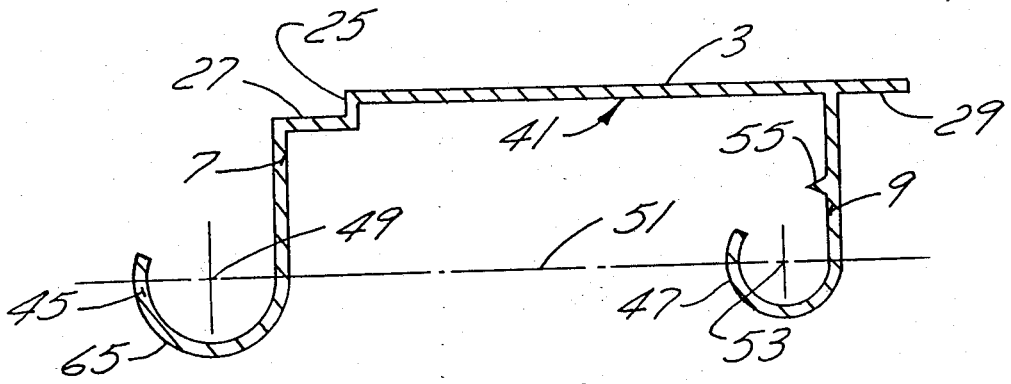
FIG. 3 is a cross-section view of the metallic panel section.

The insulated panel 1 is constructed from a first metallic panel section 41 and a second, thermoplastic panel section 43. The first panel section 41, as shown in FIG. 3 is formed by extruding a metallic member and cutting it into the required lengths equal to the desired width of the closure using the panels. The first panel section 41 has the outer wall 3 and a side wall 7, 9 extending transverse therefrom at each end. A male hinge section 45 in the form of an outwardly curved, part circular wall forms an extension of the first side wall 7. The male hinge section 45 is curved through approximately 230°. A female hinge section 47, in the form of an inwardly curved, part circular wall, forms an extension of the second side wall 9. The female hinge section 47 is curved through approximately 215° and is smaller in radius than the male hinge section 45. The center of curvature 49 of the male hinge section 45 is on an imaginary plane 51 which is parallel to the outer wall 3. The center of curvature 53 of the female hinge section 47 is also on the imaginary plane 51. The outer wall 3 of the first panel is stepped at 25 near the first side wall 7 to provide the recessed wall section 27. The outer wall 3 also has the extension 29 projecting past the other side wall 9. A rib 55 is provided on the inner side of the other side wall 9 in its central area. The rib 55 runs parallel to the outer wall 3 and is used to help connect the first and second panel sections 41, 43 together, as will be described.

Figure 4:
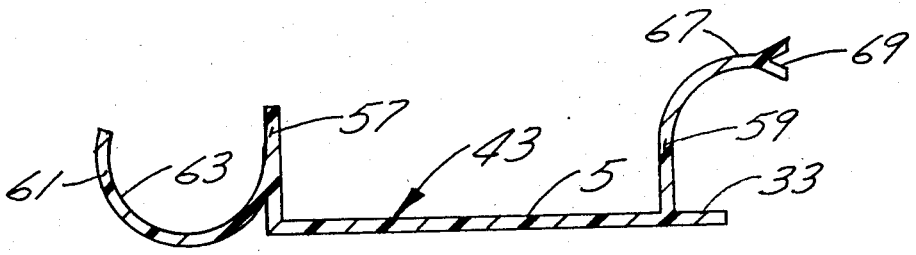
FIG. 4 is a cross-section view of the thermoplastic panel section.

The second panel section 43, as shown in FIG. 4, is formed by extruding a thermoplastic member and cutting it into the required lengths also equal to the desired width of a closure using the panels. The second panel section 43 has the inner wall 5 and a pair of side walls 57, 59 at its ends, extending transversely therefrom. A curved male hinge section 61 extends outwardly and upwardly from the first side wall 57 adjacent the inner wall 5. The male hinge section 61 is in the form of a part-circular wall curved through approximately 215°. The radius of the inner surface 63 of the male hinge section 61 is approximately the same as the radius of the outer surface 65 of the male hinge section 45 on the metallic panel section.

A curved female hinge section 67 extends upwardly and outwardly from near the top of the other side wall 59. The hinge section 67 is a part-circular wall curved through approximately 90°. The end 69 of the wall is slightly enlarged and grooved to receive the rib 55 on the side wall 9 of the metallic panel section. The inner wall 5 of the second panel section 43 also has the extension flap 33 projecting past the side wall 59.

The panel 1 is assembled by inserting the second panel section 43 within the first panel section 41 as shown in FIG. 1. The first side wall 57 of the second panel section lies against the inside of the first side wall 7 of the first panel section, and the male hinge section 57 of the second panel section 43 resiliently snaps over the male hinge section 45 of the first panel section for form male hinge element 15. At the other side, the end 69 of the female hinge section 67 of the second panel section 43 resiliently snaps over rib 55 on the side wall 9 of the first panel section 41. Female hinge section 67 is spaced from the female hinge section 47 on the first panel section 41 to form curved female hinge element 17. The hollow panel formed by the two panel sections 41, 43 is then filled with an expandable, insulating foam material 13 which securely locks the two panel sections 41, 43 together.

The panel 1 so formed is light in weight, yet strong. The inner thermoplastic panel section 43 prevents heat loss by conduction through the outer metallic panel section 41. A closure is formed by connecting a plurality of panels 1 together in series. As shown in FIG. 2 the male hinge element **15*b* of the second panel 3*b* is slidably inserted into the female hinge element 17*a* of the first panel 1*a*. The male hinge element 15*c* of the third panel 1*c* is slidably inserted into the female hinge element 17*b* of the second panel 1*b*. At each hinge connection between adjacent panels, three seals are provided between them to ensure that no drafts occur. The first seal "A" occurs where the extension 29 seats on the recessed wall section 27 of an adjacent panel. The second seal "B" occurs where male hinge element 15 contacts the flap extension 33. The third seal "C" occurs where the male hinge element 15 contacts the side wall 59 of the adjacent panel forming part of the female hinge element 17**. Thus good sealing between adjacent panels in the closure is provided.

Figure 5:
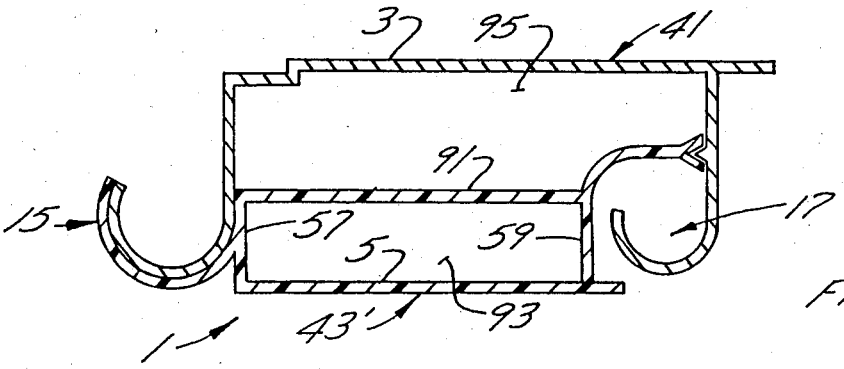
FIG. 5 is a cross-section view of another embodiment of the panel.

In another embodiment of the invention, as shown in FIG. 5, the second panel section could be made in tubular form by joining the free ends of its side walls 57, 59 together with an interior wall 91. When this modified second panel section 43' is mounted within the first panel section 41, two chambers 93, 95 are formed in the panel 1' with chamber 93 located between walls 5, 91 of the second panel section 41', and with the second chamber 95 located between the wall 91 of the second panel section 41' and the outer wall 3 of the first panel section. Both chambers 93, 95 can be left empty with the closed air spaces providing insulation; one of the chambers can be filled with insulation material; or both can be filled with insulation material.

Figure 6:
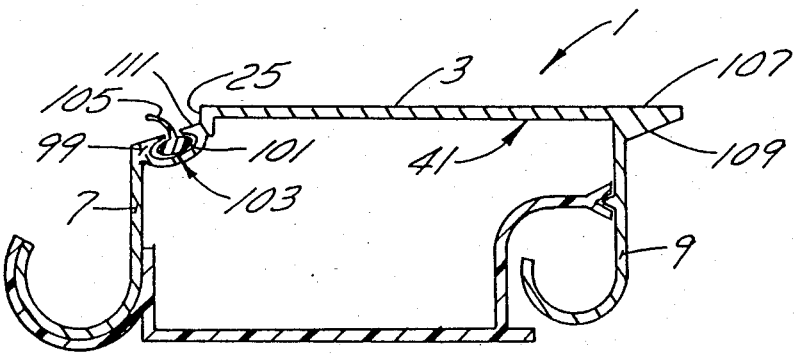
FIG. 6 is a cross-section view of a further embodiment of the panel.

In a further embodiment of the invention, the sealing means between adjacent panels on the outer face of the closure can be modified to provide improved sealing. As shown in FIG. 6, the outer wall 3 of the metallic panel section 41 of a panel 1 is stepped at 25 adjacent the one side wall 7. The recessed wall section 99 adjacent the side wall 7 can slope downwardly slightly from the step 25. A slot 101 is formed in the center of the recessed wall section opening upwardly. A T-shaped flexible sealing strip 103, made from suitable sealing material, is slidably mounted in the slot 101. The leg 105 of the sealing strip 103 is long enough to project out of the slot 101 and to lie over part of the recessed wall section 99 to provide a sealing strip.

An extension 107 of the outer wall 3 of the metallic panel section 41 is provided at its other side, projecting past the other side wall 9. When adjacent panels 1 are hingedly joined together to form a closure, the inner surface 109 of the extension 107 of one panel rests on the sealing flap 105 on the sloping surface 111 of the recessed wall section 99 of an adjacent panel to securely seal the gap between panels. The inner surface 109 of the extension 107 can, if desired, slope upwardly at the same angle that the recessed wall section 99 slopes downwardly.

It has been found, in very large closures, that the metallic section 41 in the panels 1 sometimes becomes distorted because of the weight carried by the panels 1. When the closure is unrolled, the higher panels 1 carry the weight of all the panels beneath them. This weight sometimes causes the longer, lower side wall 7 of the metallic panel section 41, forming part of panel 1, to bend down relative to the outer wall 3 and the shorter, upper side wall 9 of the section 41, thereby permanently distorting the section. Distortion can be avoided by extruding the metallic section 41 in a heavier gauge. However this is expensive. A less expensive solution is to provide means preventing distortion of the metallic panel section 41.

Figure 7:
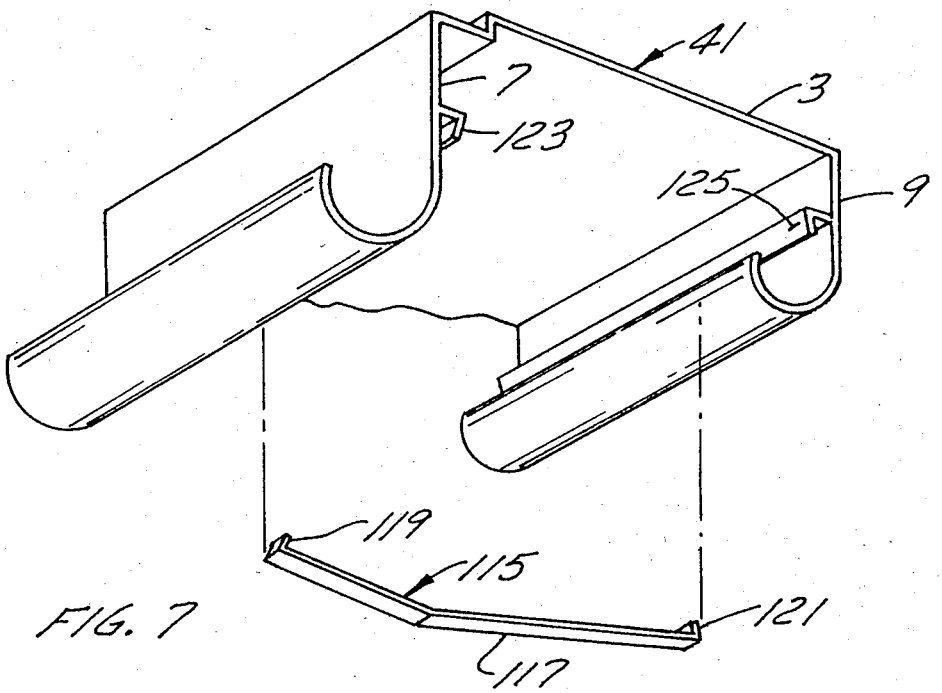
FIG. 7 is a perspective view of a modified metallic panel section and a distortion prevention slip.

In accordance with the present invention, the distortion prevention means can comprise members rigidly joining the lower and upper side walls 7, 9 together to prevent the lower side wall 7 from bending away from the upper side wall 9. The distortion prevention members can comprise clips 115 as shown in FIG. 7, formed from a substantially rigid strip 117 of metallic material. The ends of the strip 117 are bent backwards to form hooks 119, 121. The strip 117 can be straight, or bent as shown.

Figure 8:
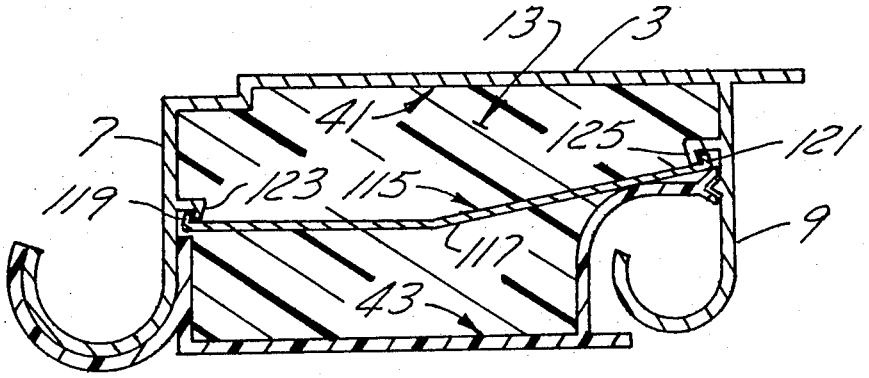
FIG. 8 is a cross-section view of a panel incorporating the modified panel section and clips.

Each side wall 7, 9 of panel section 41 is provided with an integral hooked flange 123, 125 extending inwardly from its respective inner surface as shown in FIG. 7. The hooked flanges 123, 125 are located as far away from the outer wall 3 of the panel section 41 as possible. The flange 123 on the longer side wall 7 can be located farther from the back wall 3 than flange 125 on side wall 9 is located from the back wall 3. The distance the flanges 123, 125 are located from the back wall 3 are selected to avoid interference with the plastic panel section 43 when it is mounted within metallic panel section 41 to form panel 1. The clips 115 are each "snapped" over the hooked flanges 123, 125 at longitudinally spaced-apart locations along the length of the section 41 in each panel 1 as shown in FIG. 8. The hooks 119, 121 on the clips 115 interlock with the hooked flanges 123, 125 on the side walls 7, 9 to prevent the side wall 9 from bending relative to the side wall 7. The clips 115 and/or the section 41 have enough resiliency to allow the clips 115 to be snapped in place. The spacing between the adjacent clips 115 in the panels is selected to prevent distortion. The higher the panels in the closure, the closer together are the clips in that panel. When the panels are filled with insulating material 13 such as expandable foam, the clips are enveloped by the foam and locked in place.

Throughout the disclosure reference has been made to a metallic outer wall or panel section, and a thermoplastic inner wall or panel section. Reference has also been made to the hinge elements being composed of metallic and thermoplastic material. It is to be understood however that the metallic material could be replaced by any other heat conducting material having the strength needed to form the outer portion of the closure panel, and that the thermoplastic material could be replaced by any other suitable poor heat conducting material having the necessary resilience to allow the inner panel section to snap into the outer panel section to form a panel.

I claim:

1. A closure panel comprising: a first metallic panel section having an outer wall and a pair of spaced-apart side walls extending generally transversely, and inwardly, from the outer wall, a curved male hinge section at the end of one of the side walls located outside of the side walls and opening outwardly, a curved female hinge section at the end of the other side wall, located between the side walls and opening outwardly; a second thermoplastic panel section having an inner wall, a curved male hinge section at one side of the inner wall extending past the inner wall and opening outwardly, a curved female hinge section at the other side of the inner wall extending past the inner wall and opening inwardly; the second panel section resiliently connected to the first panel section to define an enclosed space between the inner and outer walls, the female hinge section on the second panel section, and both of the side walls, with the male hinge section on the second panel section resiliently snapped over the male hinge section on the first panel section and with the female hinge section on the second panel section resiliently connected to the other side wall on the first panel section just outwardly of the female hinge section on the first panel section, the female hinge section on the second panel extending outwardly toward the outer wall of the first panel section and sideways to abut the other side wall of the first panel section.

2. A closure panel as claimed in claim 1 including cooperating means on the end of the female hinge section of the second panel section, and on the inside surface of the other side wall for helping join the first and second panel sections together.

3. A closure panel as claimed in claim 2 wherein the cooperating means comprise a groove on the end of the female hinge section and a rib, that fits in the groove, on the inside surface of the other side wall.

4. A closure panel as claimed in claim 1 including a flap extending from the other side of the inner wall in a direction away from the one side, the flap being long enough to bear against the male hinge section on the second panel section of an adjacent hingedly connected closure panel.

5. A closure panel as claimed in claim 1 wherein the space bounded by the outer and inner walls, the side walls, and the female hinge section on the second panel section is filled with insulation material.

6. A closure panel as claimed in claim 1 including a partial side wall on the second panel section extending outwardly of the inner wall at the one side thereof, the partial side wall and the male hinge section on the second panel section resiliently holding the male hinge section on the first panel section between them.

7. A closure panel as claimed in claim 1 including a first hooked flange formed on the inside surface of the one side wall on the first panel section, a second hooked flange formed on the inside surface of the other side wall outwardly of where the female hinge section of the second panel section abuts it, and a plurality of longitudinally spaced-apart clips, each hooked over the first and second flanges to hold the side walls from spreading apart.

* * * * *